United States Patent [19]

Baba

[11] Patent Number: 4,505,098

[45] Date of Patent: Mar. 19, 1985

[54] YARN SPLICING APPARATUS FOR SPUN YARNS

[75] Inventor: Susumu Baba, Kyoto, Japan

[73] Assignee: Murata Kikai Kabushiki Kaisha, Kyoto, Japan

[21] Appl. No.: 594,465

[22] Filed: Mar. 28, 1984

[30] Foreign Application Priority Data

Mar. 29, 1983 [JP] Japan ..... 58/54830

[51] Int. Cl.[3] ..... D01H 15/00; D02J 1/08

[52] U.S. Cl. ..... 57/22

[58] Field of Search ..... 57/22, 261

[56] References Cited

U.S. PATENT DOCUMENTS

| | | | |
|---|---|---|---|
| 4,393,646 | 7/1983 | Lucchetta | 57/22 |
| 4,397,140 | 8/1983 | Sheehan | 57/22 |
| 4,432,194 | 2/1984 | Luz | 57/22 |

*Primary Examiner*—Donald Watkins

*Attorney, Agent, or Firm*—Spensley, Horn, Jubas & Lubitz

[57] ABSTRACT

A yarn splicing apparatus for spun yarns including a yarn splicing member. First and second fluid injection nozzles for producing two whirling flows in the direction opposite to each other are provided at two circumferential positions of a yarn splicing hole which is formed in the yarn splicing member, and a third fluid injection nozzle for producing a non-whirling flow is also provided between the first and second nozzles.

8 Claims, 38 Drawing Figures

YARN SPLICING APPARATUS FOR SPUN YARNS

BACKGROUND OF THE INVENTION

1. Field of the Invention:

The present invention relates to a yarn splicing apparatus for spun yarns in which jet air is applied to the overlapped yarn ends.

2. Prior Art:

It is usually performed that two yarn ends are spliced to each other by causing a compressed fluid to act on the yarn end parts placed one above the other. That is, two yarn ends are first inserted in a yarn splicing hole in such a way as they direct in the directions opposite to each other. By injecting compressed air into the yarn splicing hole, the overlapped parts of those two yarn ends are then vibrated or whirled, so that filaments of the yarn end parts are entangled to make yarn splicing. One example of this yarn splicing apparatus is disclosed in U.S. Pat. No. 4,263,775.

According to such yarn splicing, there can be attained many advantages as follows. The yarn thickness at the formed joint is as much as about 1.4 times a yarn as compared with that the thickness of conventional mechanical knots, such as fisherman's knot or weaver's knot is three times a yarn. Also, it is possible to obtain a joint without including a knot, and the knitting and weaving process encounters a less possibility of yarn breakage. Further, the woven goods are free of knots in their appearance and hence have high quality.

On the other hand, there has accompanied with a problem in the point of yarn strength. Span yarns such as chemical synthetic fibers, wool, etc. have a single fiber with a larger length (50–100 mm) relative to that of cotton (30–50 mm). In such yarns which are generally calls as long fibers, the yarns or fibers constituting each yarn have the smooth surface and small friction resistance, so that simple twisting has resulted the insufficient yarn strength. Differently stated, although the leading end parts of yarn ends are mixedly twined with each other depending on the position of fluid injection, the central parts of the joint are entangled in such a condition that the two yarns are distinguishable. As a result, the joint has the less yarn strength. Alternatively, the central parts of the joint are mixed with each other into the form of one yarn, but there cause the so-called horn portions at both ends, i.e., the leading end parts of both yarn ends are not twined and separated from each other. Also in this case, the yarn strength becomes less because it depends on the yarn strength in the central parts only.

SUMMARY OF THE INVENTION

An object of the present invention is to provide a yarn splicing apparatus which is effective for not only spun yarns of short fibers but spun yarns of long fibers and can give an excellent yarn strength in the spliced portion.

According to the present invention, first and second air injection nozzle openings for producing two whirling flows in the directions opposite to each other are provided at two circumferential positions of a yarn splicing hole, and a third air injection nozzle opening for producing a non-whirling flow is provided midway between the nozzles at the above two positions, so that filaments of the both yarn ends are mixed and united with one another using the third air injection nozzle and the both yarn ends are turned in the opposite directions using the first and second air injection nozzles, thus resulting in yarn splicing such that the two yarn ends are twisted into the form of a single yarn.

BRIEF DESCRIPTION OF THE DRAWINGS

FIGS. 2 through 36 show preferred embodiments of the yarn splicing apparatus in which;

FIG. 2 is a schematic front configuration view of the yarn splicing apparatus;

FIG. 3 is a top plan view thereof;

FIG. 4 is a top plan view showing operation of the clamping device;

FIG. 5 is a top plan view showing the construction of the yarn regulating device, cutter and swivel guide plates;

FIG. 6 is a perspective view showing stoppers for the yarn handling lever;

FIG. 7 an explanatory view for adjusting operation of the position switching stopper;

FIG. 8 is a front view showing the state that the yarn ends are introduced into the yarn splicing apparatus;

FIG. 9 is sectional plan view showing one example of the yarn splicing member, FIG. 10 is a front view thereof;

FIG. 11 is a sectional plan view showing another example of the yarn splicing member in which the fluid supply path is inclined;

FIGS. 12–15 are views showing one example of the yarn splicing nozzle unit according to the present invention in which;

FIG. 12 is a top plan view;

FIG. 13 is a left side view;

FIG. 14 is a right side view;

and

Figure 12:
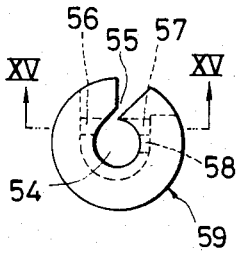
Figure 15:
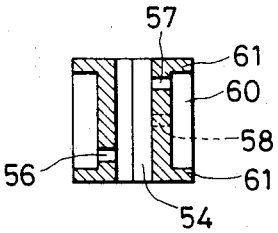
Figure 17:
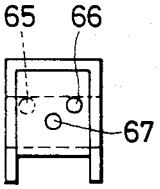
Figure 16:
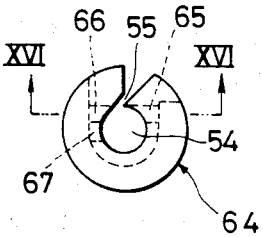
Figure 18:
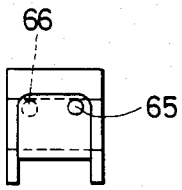
Figure 19:
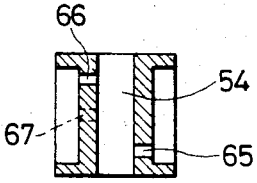
Figure 21:
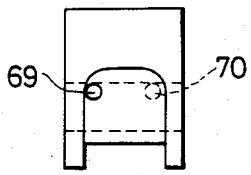
Figure 20:
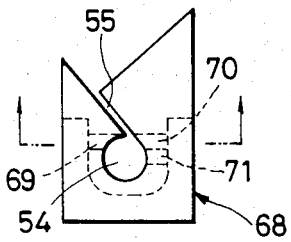
Figure 22:
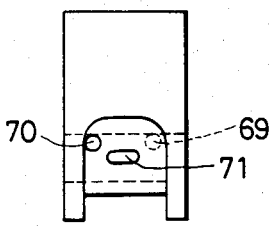
Figure 23:
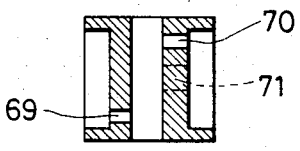
Figure 25:
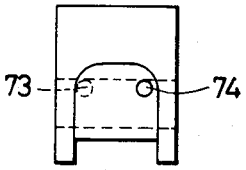
Figure 24:
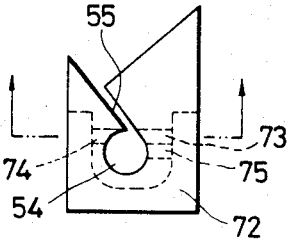
Figure 26:
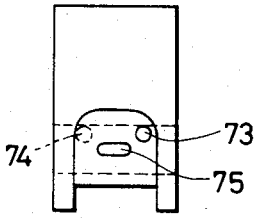
Figure 27:
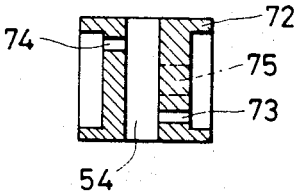
Figure 28:
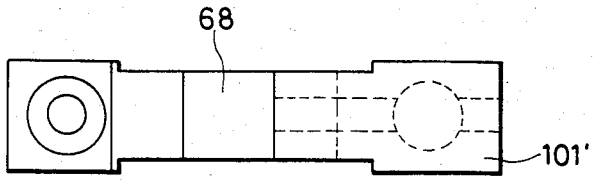
Figure 29:
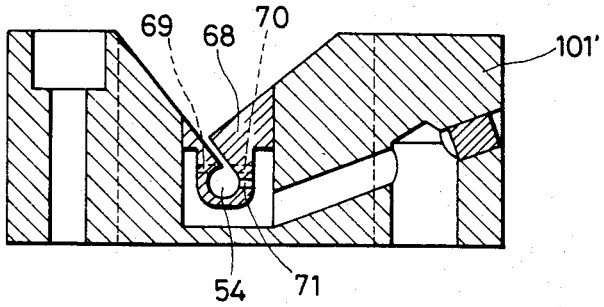
Figure 30:
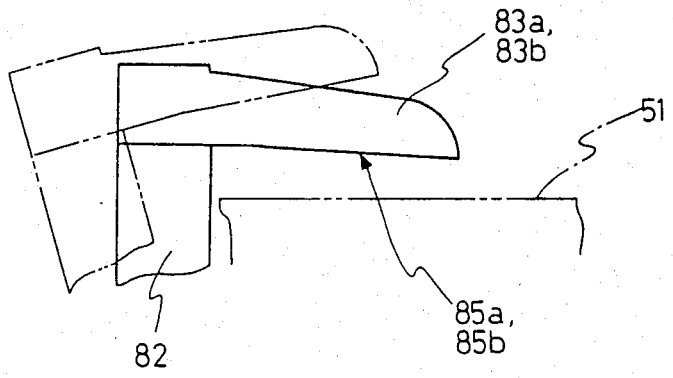
Figure 31:
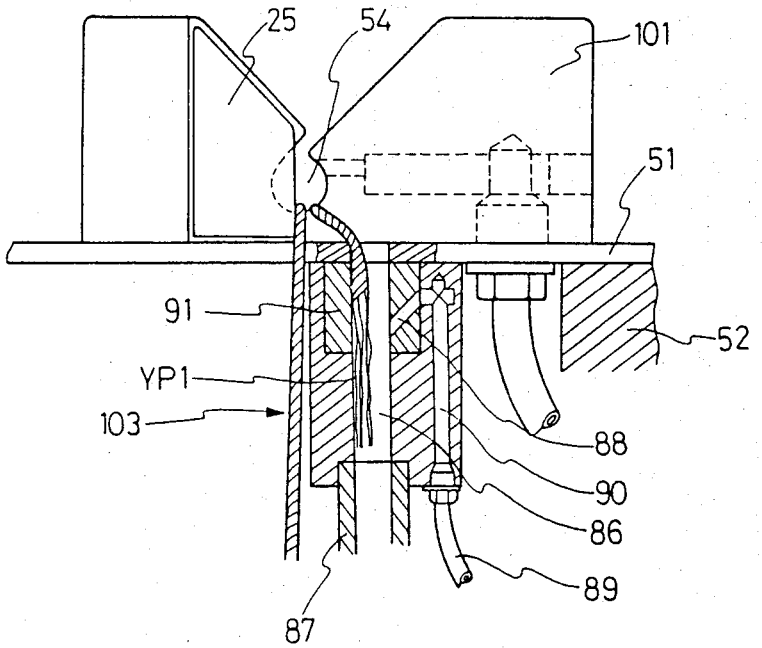
Figure 32:
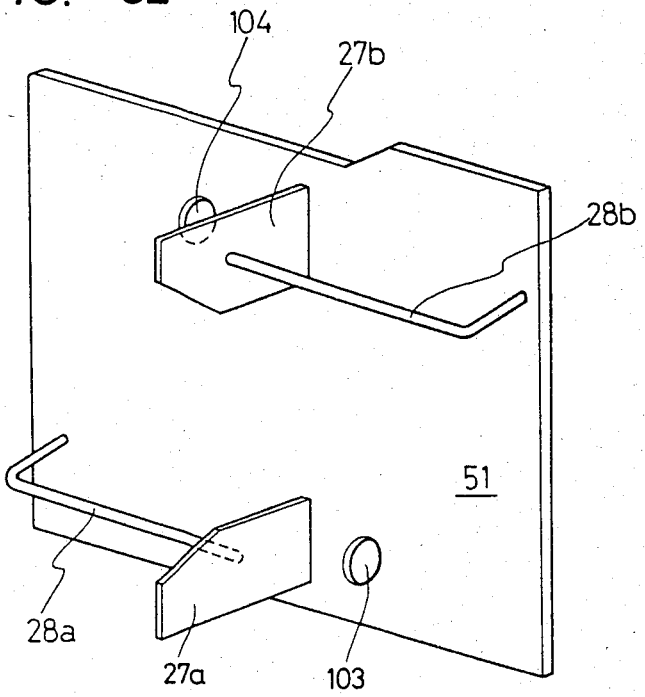
Figure 33:
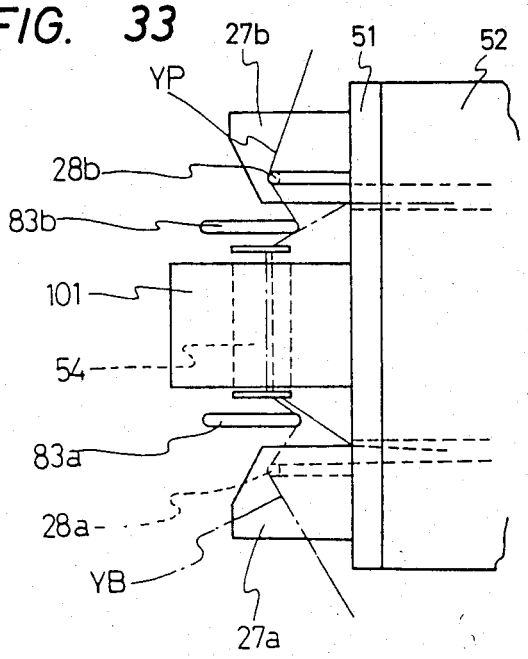

FIG. 15 is a sectional front view taken along the line XV—XV in FIG. 12;

FIGS. 16–19 are views showing the nozzle unit for S-twisting;

FIGS. 20–23 are views showing another embodiment of the yarn splicing nozzle unit;

FIGS. 24–27 are views showing the nozzle unit thereof for S-twisting;

FIGS. 28 and 29 are a front view and a sectional plan view showing the state that the nozzle unit shown in FIGS. 20–23 is set in the yarn splicing member;

FIG. 30 is a top plan view showing operation of the yarn regulating device;

FIG. 31 is a sectional plan view showing one example of the untwisting nozzle;

FIG. 32 is a perspective view showing the relationship between the guide plates and the guide rods;

FIG. 33 is a side view showing the bent state of the yarn by the guide system;

and

Figure 34:
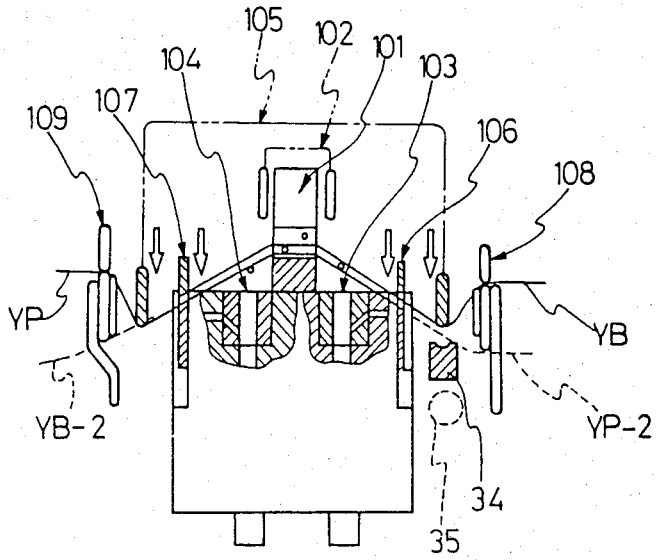
Figure 35:
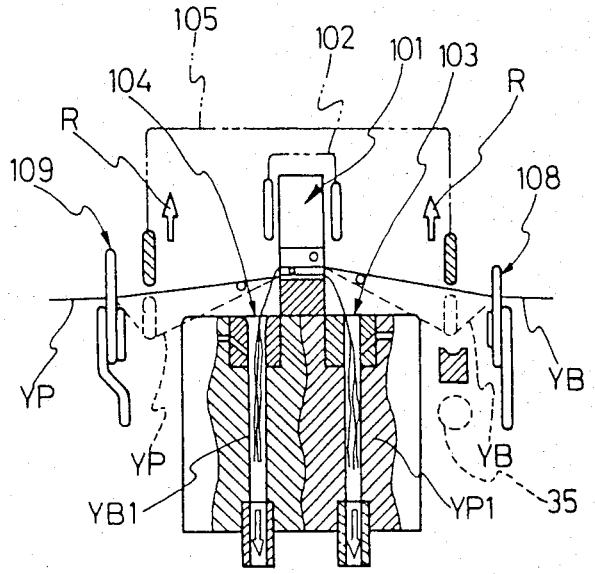
Figure 36:
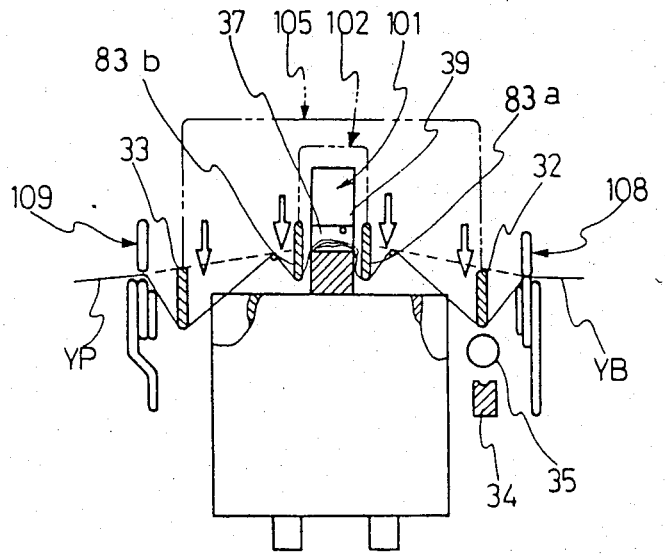
Figure 37:
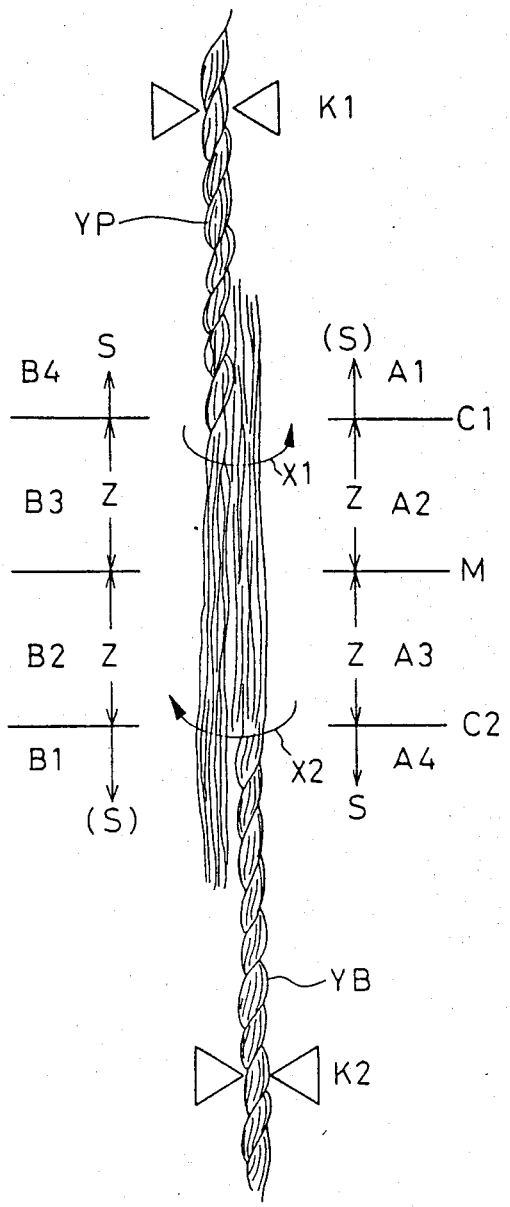

FIGS. 34–36 are explanatory views showing the yarn splicing operation of the yarn splicing apparatus;

FIG. 37 is an explanatory view for the principle of yarn splicing by the apparatus according to the present invention;

and

Figure 38:
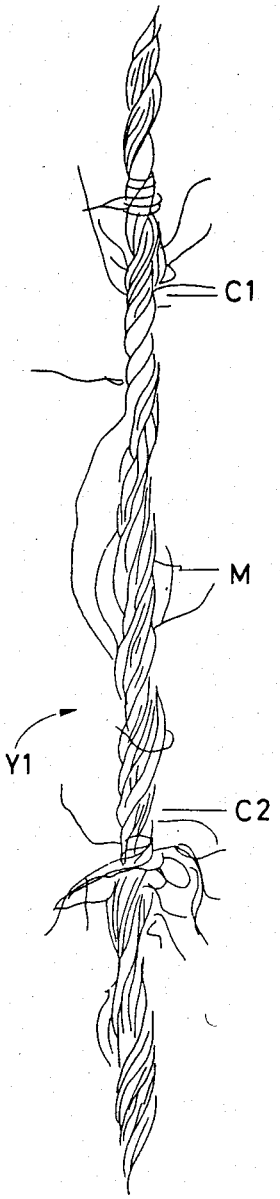

FIG. 38 is a microscopic sketch view of the joint obtained by the present apparatus.

DETAILED DESCRIPTION OF THE INVENTION

Embodiment of the present invention will be described with reference to the drawings.

Figure 1:
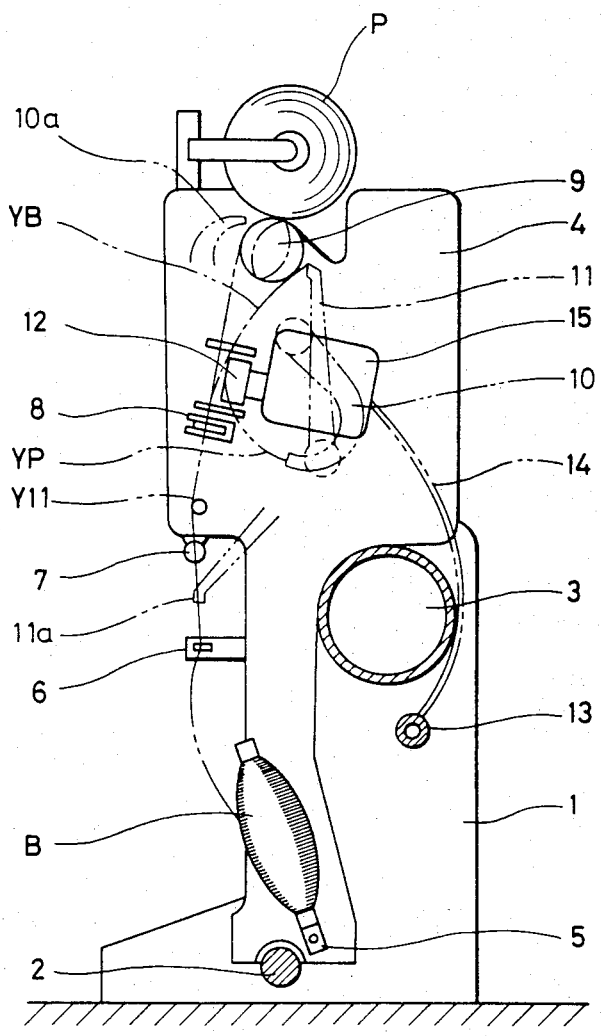
FIG. 1 is a schematic configuration view of a winder including the yarn splicing apparatus.

Referring first to FIG. 1 there is shown a schematic view of an automatic winder to which is applied the present yarn splicing apparatus. A shaft (2) and a suction pipe (3) are mounted between a pair of side frames (1) and a winding unit (4) is rotatably supported by the shaft (2). During operation of the automatic winder, the unit (4) rides over the pipe (3) to be fixed as appropriate.

Incidentially, the pipe (3) is connected to a not shown blower which always causes a suction air flow therein.

Rewinding of a yarn from a bobbin (B) to a package (P) is performed in the winding unit (4) as follows. That is, a yarn (Y11) drawn out of the bobbin (B) on a peg (5) is fed through a guide (6), a tenser (7) and a detector (8) for detecting and cutting irregularity of the yarn, such as slub, as well as for detecting running of the yarn, and then wound over the package (P) which is rotated by a winding drum (9).

On this occasion, when the detector (8) detects yarn irregularity in the yarn, a cutter arranged near the detector is operated to cut the running yarn (Y11). This stops the winding operation and, at the same time, causes the yarn splicing operation to start.

More specifically, a suction mouth (10) and a relay pipe (11) serve to guide a yarn (YP) on the package side and a yarn (YB) on the bobbin side into a yarn splicing apparatus (12) which is arranged at a position spaced from a normal yarn running path (Y11). After yarn splicing effected in the yarn splicing apparatus (12), rewinding of the yarn is restarted.

Incidentially, the suction mouth (10) and the relay pipe (11) are connected to the pipe (3) which is under the action of a suction air flow. Further, since a fluid such as compressed air is used in the yarn splicing apparatus, a conduit (14) is connected between a pipe (13) belonging to another system and a yarn splicing unit (15).

Figure 2:
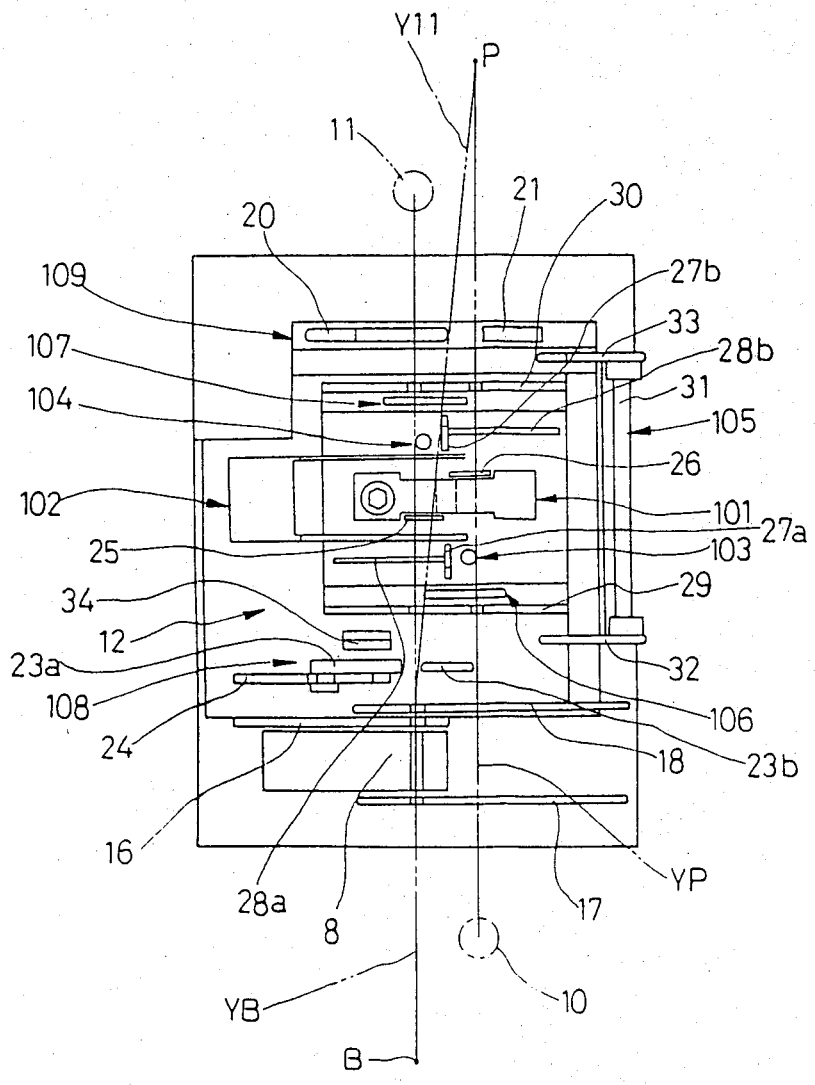
Figure 3:
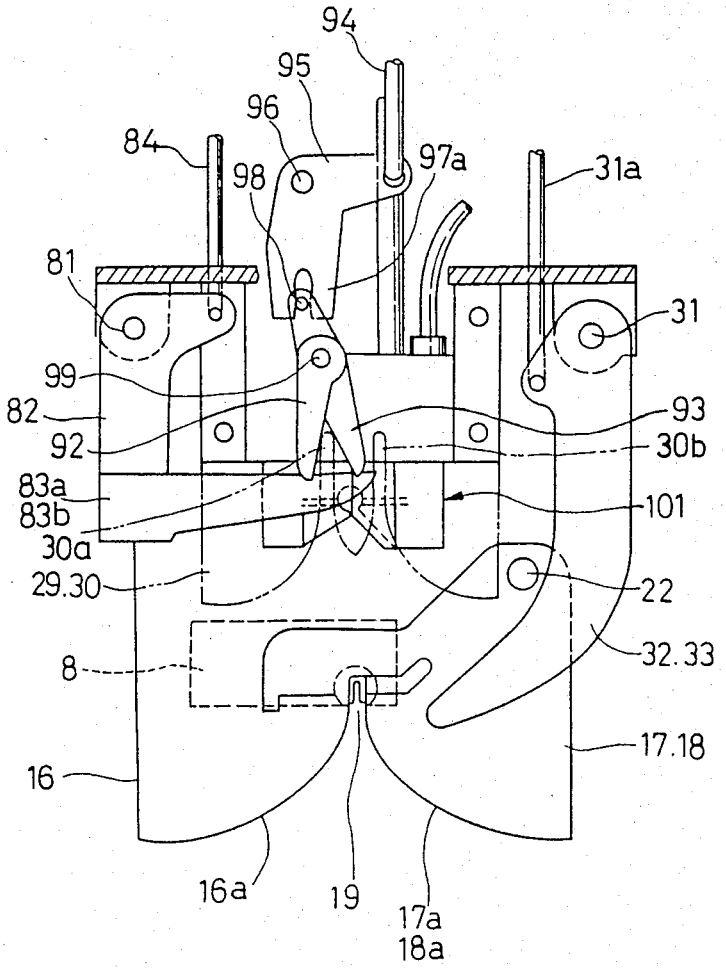

FIGS. 2 and 3 show the schematic construction of the yarn splicing apparatus (12).

During the normal rewinding operation, the yarn (Y11) follows a path leading from the bobbin (B), the detector (8), a fixed guide (16) provided on one side of the detector (8), a pair of swivel guide (17), (18) provided on both sides of the detector and to the package (P) while passing above the yarn splicing apparatus (12).

The yarn splicing apparatus (12) is basically composed of a yarn splicing member (101), yarn regulating device (102), untwisting nozzles (103)(104), yarn handling lever (105), yarn cutters (106)(107) and yarn clamping devices (108)(109). Suction ports at the ends of the suction arm (10) and relay pipe (11) are turned above the yarn splicing apparatus (12) in a crossing relation to each other to suck the yarn end (YP) on the package side and the yarn end (YB) on the bobbin side, respectively, and then stopped after moving to the outside of the yarn splicing apparatus (12).

Incidentially, operations of the suction mouth (10) and the relay pipe (11) are effected not simultaneously but with a somewhat time lag therebetween.

Figure 4:
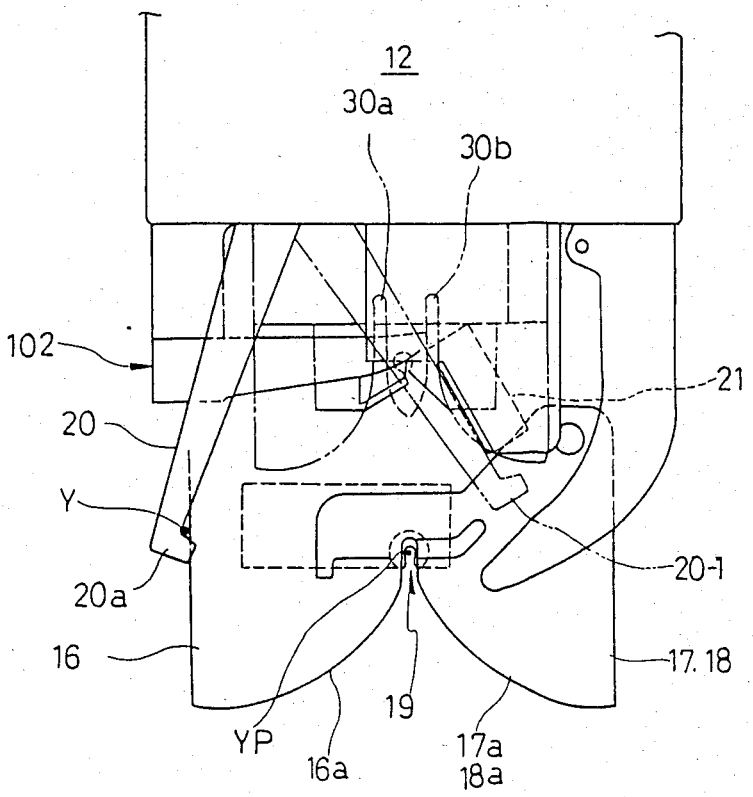

That is, the yarn end (YP) on the package side is first turned by the suction mouth (10) to the outside of the yarn splicing apparatus (12) and then stopped there. As soon as the yarn end (YP) has stopped, the swivel lever (20) of the yarn clamping device (109) on the package (P) side is swiveled by a control cam (not shown) in the counterclockwise direction up to the position (20-1) indicated by chain-dotted lines as shown in FIG. 4, and then stopped by abutting against a support block (21) fixed in a predetermined position.

At this time, the yarn (YP) is moved while being hung onto a hook portion (20*a*) of the swivel lever (20) and then held between the support block (21) and the swivel lever (20).

On the other hand, while the swivel lever (20) is operated as stated above, the yarn (YP) locating on the fixed guide (16) and the swivel guides (17)(18) advances along inclined surfaces (16*a*), (17*a*) and (18*a*) of the guides (16), (17) and (18) into a guide groove (19). The detector (8) disposed in the same level as the guide groove (19) confirms the presence or absence of the yarn (YP), whether two or more yarns have been erroneously suctioned by the suction mouth or not, etc. After confirmation of the yarn (YP), the swivel guides (17)(18) are swiveled counterclockwise by a control cam (not shown) about a support shaft (22) as shown in FIG. 5, whereby the yarn (YP) comes apart from the detector (8) and penetrates into escape grooves (17*a*)(18*b*) of the swivel guides (17)(18).

As soon as the swivel guides (17)(18) have swiveled, the yarn end (YB) on the bobbin (B) side is sucked by the relay pipe (11), the latter being turned in the direction opposite to the suction mouth (10) and then stopped after moving to the outside of the yarn splicing apparatus (12).

Further, as soon as the relay pipe (11) has stopped in its swivel, a support plate (23*a*) of the yarn clamping device (108) is moved by a control cam (not shown) along a guide plate (24) in the same direction as the swivel lever (20) while hanging the yarn (YB), and then abutted against a support block (23*b*) fixed in a predetermined position to hold the yarn (YB) between the support plate (23*a*) and the support block (23*b*).

Figure 5:
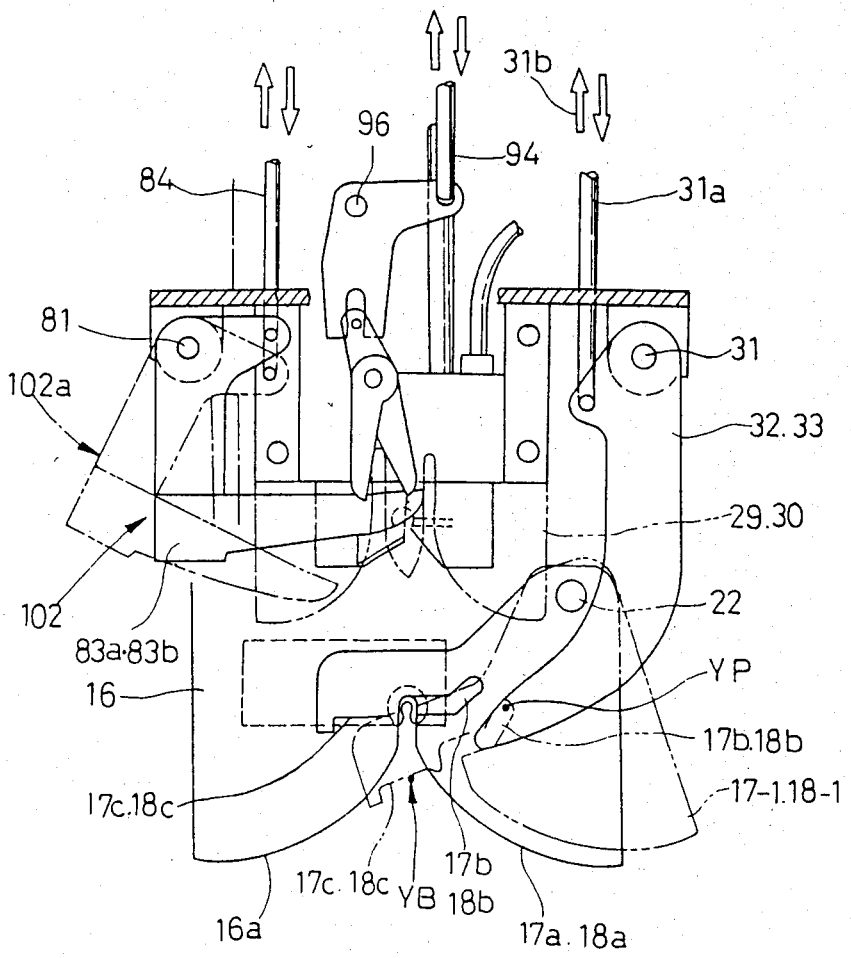

On this occasion, the yarn (YB) is hung onto hook portions (17*c*)(18*c*) near guide ends of the swivel guides (17)(18) as shown in FIG. 5. Check by the detector (8) is carried out after the completion of yarn splicing.

Nearly the center of the yarn splicing apparatus (12) there is arranged a yarn splicing member (101), and on both sides of the yarn splicing member (101) there are arranged yarn end control plates (25)(26), yarn regulating device (102), untwisting nozzles (103)(104), guide plates (27*a*)(27*b*), guide rods (28*a*)(28*b*), yarn cutters (106)(107) and fork guides (29)(30) in this order, as shown in FIG. 2.

Further, on the side of the yarn splicing member (101) there is arranged the yarn handling lever (105) which comprises a support shaft (31) and levers (32)(33) capable of swivelling about the shaft (31). The yarn handling lever (105) serves to guide both yarns (YP) and (YB) toward the yarn splicing apparatus (12) after the detector (8) has detected slub, narrowness, etc. of the yarn (Y11), the cutter (not shown) has cut the yarn and both suction arm (10) and relay pipe (11) have been operated to guide the yarn ends (YP) and (YB) to the outside of the yarn splicing apparatus (12), respectively.

Incidentially, the yarn handling lever (105) is capable of swiveling in a range until it abuts against a stopper (34) arranged between the fork guide (29) and the yarn clamping device (108).

The stopper (34) is movable between two positions and fixes the position where the yarn handling lever (105) is to be stopped, the stopper functioning at the time of yarn splicing effected by the yarn splicing apparatus. There is also provided another stopper (35) for adjusting the length of the overlapped yarn ends, as shown in FIG. 6.

Figure 6:
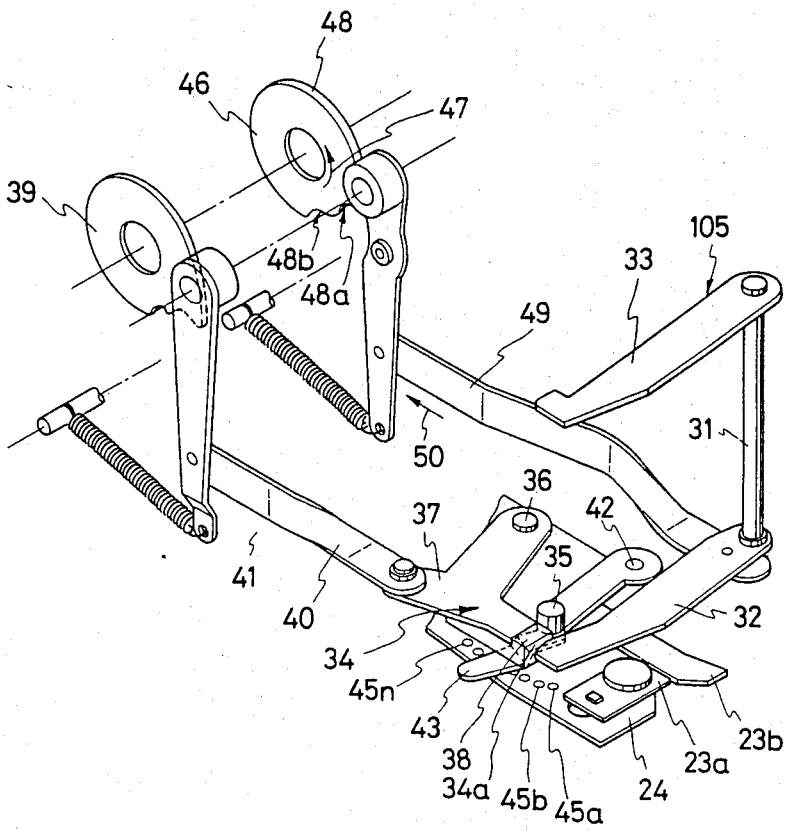

More specifically, referring now to FIG. 6, the first stopper (34) is so arranged that a block (38) is fixed to the distal end of a lever (37) which is rotatable between two positions about a fixed shaft (36). The stopper (34) is fixed at either the operable position as shown in FIG. 6 or the inoperable position having been rotated in the direction of an arrow (41), through a rod (40) in association with a control cam (39).

That is, at the time when the yarn cutters (106)(107) cut the yarn, the lever (32) of the yarn handling lever (105) locates at the position where it abuts against the first stopper (34), thereby to make constant the length from the clampled point of yarn end to the leading end of yarn end.

Figure 7:
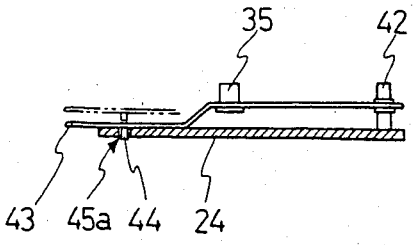

Meanwhile, the second stopper (35) is fixed to the upper surface of an adjusting lever (43) which is rotatable about a fixed shaft (42). As shown in FIG. 7, to the lower surface of the lever (43) is fixed a pin (44) which is engaged with any desired one of plural positioning holes (45*a*)–(45*n*) bored along an arc of a circle, whereby the position of the second stopper (35) is determined selectively.

When a cam (46) is rotated in the direction of an arrow (47), its cam furface (48*a*) causes a rod (49) to be pulled in the direction of an arrow (50), so that the lever (32) is swiveled up to the position of the first stopper (34). At the same time, there performs yarn splicing. Subsequently, the lever (32) is once returned in the reverse direction and, at this time, the cut yarn end is sucked into a later-described untwisting nozzle.

Thereafter, a cam surface (48*b*) causes the lever (32) to be swiveled again up to the position of the second stopper (35). On this occasion, the first stopper (34) has already been turned by the cam (39) into the inoperative position, i.e., the position behind the second stopper (35). In other words, the drawn-out amount of yarn ends from the untwisting nozzle, i.e., the overlapped amount of both yarns in the yarn splicing member is determined by the fact that the lever (32) is swiveled up to the position where it abuts against the second stopper (35). As the swivel amount of the yarn handling lever is increased, the drawn-out amount of yarn ends becomes larger and the overlapped length is shortened.

Figure 8:
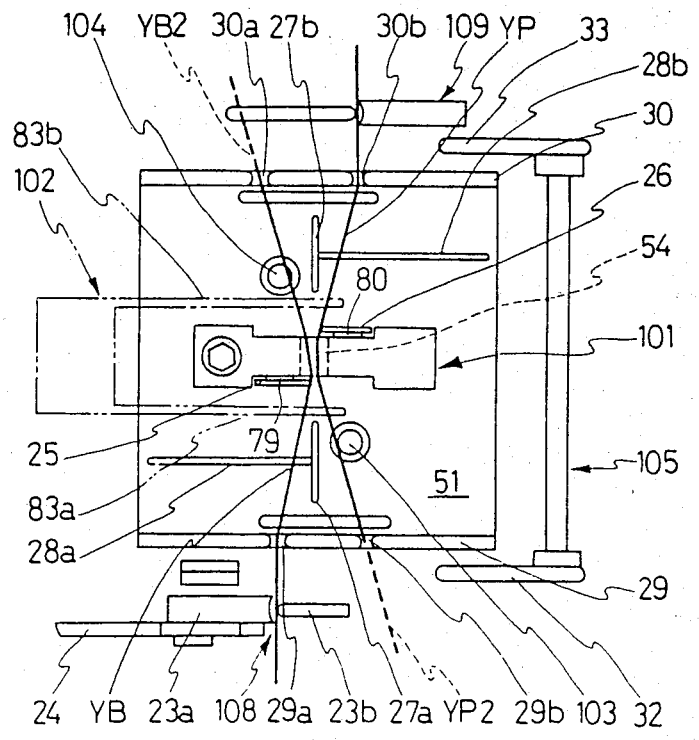
Figure 9:
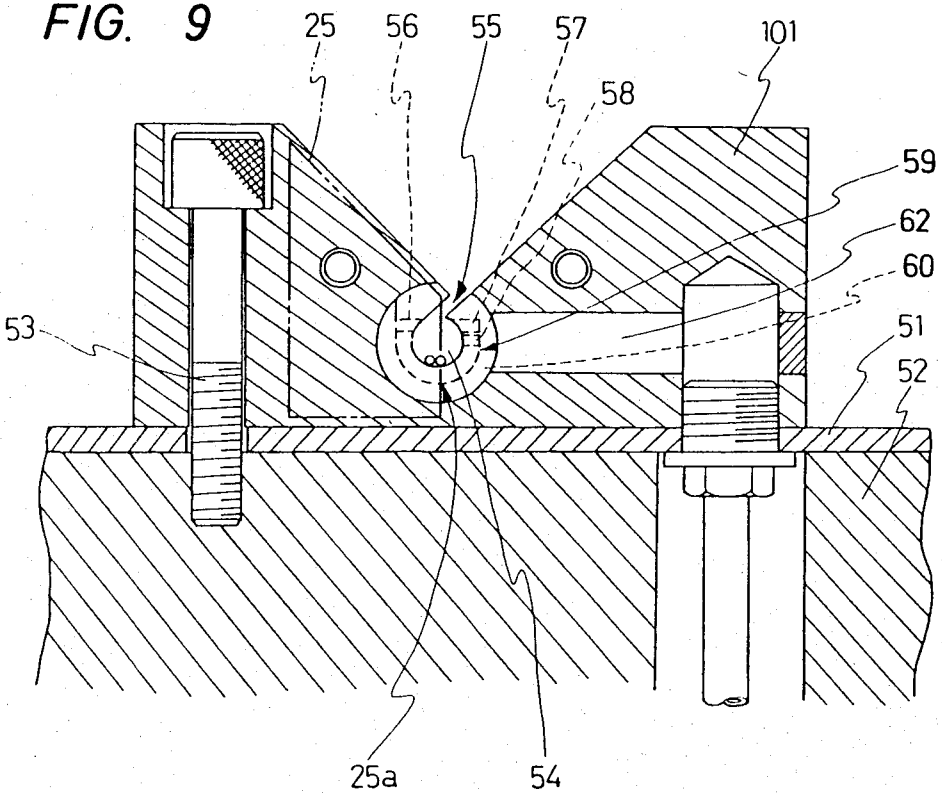
Figure 10:
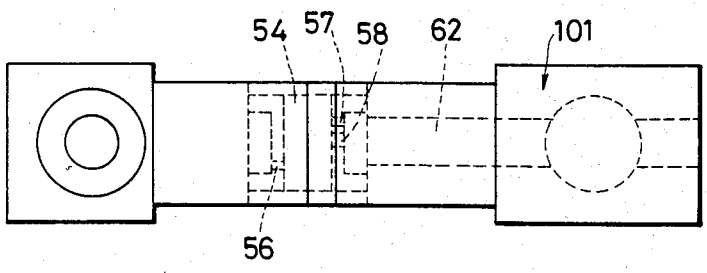

FIGS. 8–10 show the yarn splicing member (101). The yarn splicing member (101) is screwed at (53) to a bracket (52) through a front plate (51), and formed at the nearly central part with a cylindrical yarn splicing hole (54). A slit (55) suitable for inserting the yarns (YP)(YB) therethrough from the outside is formed all over the circumference of the yarn splicing hole (54) in the tangential direction. Further, first and second fluid injection nozzles (56)(57) are bored to be open to the yarn splicing hole (54) in a tangential relation, and a third fluid injection nozzle (58) is bored midway between the nozzle (56) and (57) to be open to the yarn splicing hole (54) in a non-tangential relation.

It is to be noted that the yarn splicing member (101) shown in FIG. 9 comprises a yarn splicing nozzle unit (59) fitted detachably and formed with the yarn splicing hole (54), and one embodiment of the unit (59) is shown in FIGS. 12–15. More specifically, the yarn splicing nozzle unit (59) has the substantially cylindrical form and includes the first and second injection nozzles (56)(57) open to the yarn splicing hole (54) in a tangential relation at such two positions as causing fluid flows injected from those nozzles to be whirled in the opposite directions, as well as the third nozzle (58) open to the yarn splicing hole (54) in a non-tangential relation.

The nozzles (56)(57)(58) are also open to a fluid passage (60) formed in the periphery of the cylindrical nozzle (59). In the state where the nozzle (59) is fitted into the yarn splicing member (101), as shown in FIG. 9, the passage (60) forms an enclosed passage in cooperation of the peripheral wall surface of a nozzle inserting hole formed in the yarn splicing member and upper and lower flange portions (61)(61) of the nozzle (59), a part of the passage (60) being connected to a fluid supply path (62) formed in the yarn splicing member (101).

Figure 14:
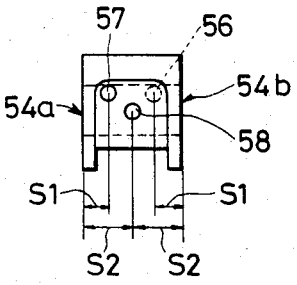

As shown in FIG. 14, the positions of the first, second and third fluid injection nozzles (56)(57)(58) in the axial direction of the yarn splicing hole (54) are so selected that the first and second nozzles (56)(57) locate in symmetrical positions spaced from yarn splicing hole end faces (54*a*)(54*b*) by a distance of (S1), respectively, and the third nozzle (58) locates at the center of the yarn splicing hole (54), i.e., a position spaced from the above both end faces by a distance of (S2).

Figure 11:
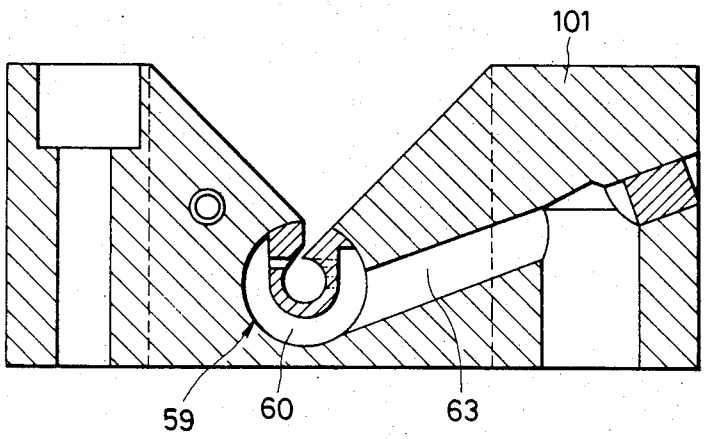
Figure 13:
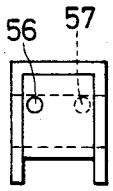

In this connection, FIG. 11 shows another embodiment in which a fluid supply path (63) is formed obliquely in a substantially tangential relation relative to the passage (60), in order that there occurs no time lag in fluid injections from the first, second and third fluid injection nozzles (56)(57)(58). For the purpose of stabilizing the fluid flow, it is preferable that the sectional areas of the supply path (62)(63) and the passage (60) surrounding the nozzle (59) at a right angle with respect to the fluid running direction are made equal to each other.

Incidentially, the yarn splicing nozzle (59) as shown in FIGS. 12–15 is a nozzle for use in the case that the yarns to be spliced have the specific Z-twist. That is, it is a nozzle unit suitable for causing the yarn end on the package side and the yarn end on the bobbin side to be whirled in the untwisting directions by the nozzles (56), (57), respectively.

On the other hand, a nozzle unit (64) shown in FIGS. 16–19 is fit for use in the case that the yarns have the specific S-twist. In this nozzle unit, a first nozzle (65) for whirling the yarn end on the package side and a second nozzle (66) for whirling the yarn end on the bobbin side are set to produce the injected fluid flows whirling in the directions opposite to those in the case of the foregoing nozzle unit (59).

In addition, a third nozzle (67) is opened on the side of the nozzle (65), i.e., it is formed to be open in the direction opposite to that in the case of the nozzle (59).

FIGS. 20–23 show another embodiment of the yarn splicing nozzle unit. More specifically, a nozzle unit (68) has the square pillar form as a whole, which eliminates the need of adjusting the position of the nozzle unit when it is fitted into the nozzle block, and hence which permits one-touch fitting. Further, first and second fluid injection nozzles (69)(70) are, similarly to the nozzles in the foregoing embodiment (FIG. 15, (56)(57)), open to the yarn splicing hole (54) in a tangential relation with a circular cross section, while a third fluid injection nozzle (71) is formed to have a flat opening in cross section elongated in the axial direction of the yarn splicing hole (54). More specifically, the flat opening (71) is in a non-tangential relation relative to the yarn splicing hole (54) and is preferably directed toward the center of the hole (54). Also, in the side view of FIG. 22, the flat opening is so positioned that both lengthwise ends of the opening will not interfer with the first and second nozzles, in order to avoid that the fluid flows injected from the nozzles (69)(70)(71) will not interfer with one another in the initial stage. In this modified embodiment, since the flow rate of fluid injected from the third nozzle (71) is increased, the stronger force of the compressed fluid can be applied to the central parts of the overlapped yarn ends, thereby permitting to further promote mixing and tangling of fibers.

The above nozzle unit (68) is fit for use in the case that the yarns to be sliced have the specific Z-twist. On the other hand, FIGS. 24–27 show a nozzle unit (72) fit for use in the case of the yarns of S-twist, in which first and second fluid injection nozzles (73)(74) are positioned in the opposite sides to those in the foregoing nozzle unit (59), i.e., they are open to the yarn splicing hole (54) in a tangential relation at such positions as causing the fluid flows to be whirled in the directions to untwist the yarn ends. A third fluid injection nozzle (75) is opened on the side of the first nozzle (73) and has a flat opening.

FIGS. 28 and 29 show the state where the above yarn splicing nozzle unit (68) or (72) is fitted into a yarn splicing member (101'). The compressed fluid supplied from a fluid supply path (76) is injected through a passage (77) into the yarn splicing hole (53) from the first, second and third fluid injection nozzles (69)(70)(71).

In any case of the foregoing yarn splicing nozzle units (59)(64)(69)(72), the nozzles at two positions are so located that the openings of those nozzles are opposite to each other in a top plan view on the side where the yarn inserting slit is opened in a tangential relation. This is resulted from the reason that the fluid flow injected from one nozzle (57)(65)(69) or (74) has a low possibility to flow out through the slit (55), while the fluid flow injected from the other nozzle (56)(66)(70) or (73) has the whirling direction in coincidence with the opening direction of the slit and has a high possibility to flow out through the slit. It is, therefore, so arranged that the injected flow from the nozzle (56)(66)(70) or (73) first goes straight across the slit position and the fluid having been whirled along the inner periphery surface of the yarn splicing hole is then interrupted by the going-straight flow injected from the third nozzle, thereby to reduce the amount of the whirled fluid flowing out through the slit to the minimum.

As an alternative, it is also possible to arrange each pair of nozzles (56)(57), (65)(66), (69)(70) or (73)(74) on the same side with respect to the plane passing the center of the yarn splicing hole.

Referring back to FIGS. 8 and 9, to both sides of the yarn splicing member (101) screwed through spacers (79)(80) the control plates (25)(26), which have specific side edges (25*a*)(26*a*) positioned such that they partially cross the opening of the yarn splicing hole (54).

As to the control plates (25)(26), the upper control plate (26) serves to control the yarn (YP) leading to the package, while the lower control plate (25) serves to control the yarn (YB) leading to the bobbin.

Therefore, the control plate (26) is disposed on the side opposite to the nozzle (56), while the control plate (25) is disposed on the side opposite to the nozzle (57).

More specifically, the control plates (25)(26) serve, together with the later-described yarn regulating lever (102), to locate the two yarns inserted into the yarn splicing hole (54) in positions where they come into contact with each other, ensure the initial entangling of both yarn ends at the time of fluid injection, prevent untwisting of both yarn ends when they are whirled in the separated state, control the flow rate of fluid discharging out of both end openings of the yarn splicing hole (54), prevent the yarn ends from flying out, restrict turning of the clamped parent yarns, and further to control the fluid flows so as to ensure the sufficient entangling of the yarn end parts with each other.

Moreover, when the injected fluids act on the yarn ends (YP)(YB), there occurs a ballon. If the number of rotations of the balloon is increased, each fiber near the balloon neck comes into the unwhirled state due to the yarn throwing-about action of the baloon, thereby the yarn becomes liable to cut.

Thus, the number of rotations of the balloon is controlled to the value suitable for yarn splicing by the control plates (25)(26).

The yarn regulating device (102), shown in FIGS. 3, 5 and 8, arranged to locate on both sides of the yarn splicing member (101) functions, in association with a turning movement of the yarn handling lever (105) (later-described), to draw out the yarn ends (YP)(YB) untwisted by the yarn end untwisting nozzles (103)(104) therefrom, then set them in the yarn splicing hole (54) of the yarn splicing member (101) and then restrict the relative positions of the yarns (YP)(YB) in association with the control plates (25)(26), at the time of yarn splicing.

The yarn regulating device (102) has also such a function as to bend the yarns between the clamped points and the yarn splicing hole in association with the later-described guide rods (28*a*)(28*b*), thereby preventing further propagation of untwisting.

As shown in FIG. 3, the yarn regulating device (102) is so arranged that yarn regulating plates (83*a*)(83*b*) are fixed to a lever (82) rotatable about a support shaft (81) fixed in the given position, and a rod (84) is operated by a control cam (not shown) to rotate the yarn regulating plates (83*a*)(83*b*), as shown in FIG. 5.

Also as shown in FIG. 30, the yarn regulating plates (83*a*)(83*b*) are each shaped into the fork form toward its leading end and have the same shape. In the operative state, yarn regulating side edges (85*a*)(85*b*) of the regulating plates (83*a*)(83*b*) locate above the upper surface of the front plate (51) to which is fixed the yarn splicing member, so that the yarn will never be held between the yarn regulating plates (83*a*)(83*b*) and the front plate (51).

The yarn end untwisting nozzles (103)(104) arranged on both sides of the yarn retaining device (102) have the same construction, so one untwisting nozzle (103) will be described by referring to FIG. 31.

The yarn end (YP1) on the package side to be sliced is introduced through the yarn splicing hole (54) into a nozzle port (86) circular in cross section formed in the bracket (52).

This introduction of the yarn end (YP1) into the nozzle (86) is effected by the sucking action induced with the suction pipe (3) through a flexible pipe (87).

When the yarn end (YP1) is introduced into the nozzle (86), the fluid injection from a fluid injection nozzle (88) obliquely open to the nozzle (86) acts on the yarn end (YP1) to untwist the same into such a state that fibers are extended substantially parallel to one another.

Incidentially, the injection nozzle (88) is preferably bored in a tantential relation relative to the inner peripheral surface of the nozzle (86) so as to cause the fluid flow whirling in the direction opposite to the twisting direction of the yarn end.

Supply of the fluid to the injection nozzle (88) is effected through a communication hole (90) and a pipe (89) connected to the aforesaid conduit (14).

It is to be noted that the length of the yarn end to be untwisted is varied depending on the position of the fluid injection nozzle (88) open to the nozzle, i.e., the distance from the opening surface of the nozzle at its upper end.

It is, therefore, preferable to make the opening position of the injection nozzle adjustable in accordance with various conditions such as whether the yarns have the short or long average fiber length, in order to obtain the optimum untwisted state of the part to be overlapped in the yarn splicing hole of the yarn splicing member. From this reason, a sleeve (91) is fitted to allow its advance or retreatment as required.

Next, the guide system fixed to the front plate (51) will be described by referring to FIGS. 8, 32 and 33.

The guide plates (27*a*)(27*b*) are located on the center line of the yarn splicing hole (54) and vertically fixed to the front plate (51), as shown in FIG. 8, so that the suction forces from the yarn end untwisting nozzles (103)(104) will not affect the yarns (YB)(YP) not to be sucked thereby, respectively.

Further, guide rods (28*a*)(28*b*) are fixed to the side faces of guide plates (27*a*)(27*b*) on one side thereof at a level spaced from the upper surface of the front plate (51). The guide rods (28*a*)(28*b*) are extended in parallel to the upper surface of the front plate (51) up to both side ends of the front plate (51), respectively, and then bent in the form of L so as to be fixed to the front plate (51).

As shown in FIG. 33, therefore, the yarns (YP)(YB) inserted into the yarn splicing hole (54) by the yarn handling lever (105) follow paths which are in contact with the guide rods (28*a*)(28*b*) and spaced from the front space (51).

In other words, as previously noted, it is so arranged that in cooperation with the yarn regulating lever (102) the guide rods (28*a*)(28*b*) cause the yarns to be bent between the yarn splicing hole (54) and the clamping devices (108)(109) during the yarn splicing operation, thereby to prevent further propagation of untwisting of the yarns due to the whirling flows within the yarn splicing hole.

Referring to FIGS. 2, 3 and 5, the yarn cutters (106)(107) are provided inside of the guide plates (29)(30), respectively, and are each composed of a fixed blade (92) and a movable blade (93). As seen from FIG. 3, when a rod (94) is operated by a control cam (not shown), a fork-like bifurcated lever (95) is swiveled clockwise or counterclockwise about a shaft (96), whereby a fork portion (97*a*) of the lever (95) causes a support pin (98) at the other end of the movable blade (93) to be moved. As a result, the movable blade (93) is operated about a shaft (99).

Further, as shown in FIG. 8, the fork guides (29)(30) fixed outside of the yarn cutters (106)(107) are formed with guide grooves (29*a*)(29*b*), (30*a*)(30*b*).

Moreover, as seen from FIGS. 3 and 5, the yarn handling lever (105) arranged on the side of the yarn splicing member (101) is swiveled by a control cam (not shown) through a rod (31*a*) in the clockwise direction about the shaft (31) so as to introduce the yarns (YP)-(YB) into the guide grooves (29*a*)(29*b*), (30*a*)(30*b*) and then into the yarn splicing hole (54) from the inclined surface of the yarn splicing member through the slit.

Next, there will be described the yarn splicing operating using the yarn splicing apparatus thus constructed.

(I) Yarn preparing/clamping process

In FIG. 1, when the detector (8) detects cutting of the yarn or absence of yarn layers in the bobbin during the rewinding operation, the drum (9) is stopped in its rotation and, at the same time, a one-rotation clutch (not shown) is actuated so that the yarn splicing operation is performed by various control cams mounted over a shaft rotated through the clutch as well as other various control cams rotated in conjunction with the shaft.

First, the suction mouth (10) and the relay pipe (11) are turned from the positions (10*a*)(11*a*) as indicated by chain-dotted lines in FIG. 1 while sucking the corresponding yarn ends, then pass above the yarn splicing apparatus (12) in such a way as the yarn (YP) on the package (P) side crosses with the yarn (YB) on the bobbin (B) side, and then are stopped after moving up to the outside of the yarn splicing apparatus.

More specifically, during the time until the relay pipe (11) is started to operate after operation of the suction mouth (10), as shown in FIGS. 4 and 5, the yarn clamping device (109) on the package side is operated to hold the yarn (YP) between the swivel lever (20) and the support block (21), and the yarn (YP) is introduced into the guide groove (19) commonly formed in the fixed guide (16) and the swivel guides (17)(18) arranged near the detector (8), so that the yarn is checked by the detector (8). Subsequently, the swivel guides (17)(18) are swiveled about the shaft (22) up to the positions (17-1)(18-1) as indicated by chain-dotted lines, thus removing the yarn (YP) out of the detector (8) and inserting it into the escape grooves (17*b*)(18*b*).

Thereafter, the relay pipe is turned up to the position outside of the yarn splicing apparatus (12) while sucking the yarn (YB) on the bobbin (B) side, and then stopped there.

On this occasion, the yarn (YB) passes over the hook portions (17*c*)(18*c*) of the swivel guides (17)(18), and it is then held between the support plate (23*a*) and the support block (23*b*) of the yarn clamping device (108).

(II) Yarn handling/cutting process

After completion of the yarn clamping process, the levers (32)(33) of the yarn handling lever (105) shown in FIGS. 2 and 8 are turned about the support shaft (31), thereby causing the yarns (YP)(YB) on both sides to be introduced into the corresponding guide grooves (29*a*)(29*b*), (30*a*)(30*b*) of the fork guides (29)(30) separately and then inserted into the yarn splicing hole (54) of the yarn splicing member (101) through the slit (55).

Next, as shown in FIG. 8, yarn cuttings (YP2)(YB2) are effected by the yarn cutters (106)(107) at the positions spaced from the clamping devices (108)(109) by a predetermined distance.

The cutting position of the yarn is related to the length of the joint for yarn splicing and gives an influence on the condition of appearance of the joint after yarn splicing as well as the strength thereof. Also, the cutting position should be varied depending on the number of yarn count.

More specifically, yarn cutting is effected in such a state that, in FIG. 34, the yarns (YP)(YB) on both sides of the yarn splicing member (101) are held by the yarn clamping devices (108)(109), and the yarn handling lever (105) is so operated that the rod (31*a*) shown in FIG. 5 has moved in the direction of an arrow (31*b*) by a control cam (not shown) and the levers (32)(33) has turned clockwise about the support shaft (31).

Incidentially, during operation of the yarn handling lever (105) and the cutters (106)(107), the yarn regulating device (102) is on standby at the position (102*a*) indicated two-dot chain lines as shown in FIG. 5.

(III) Yarn end untwisting process

Subsequently, as shown in FIG. 35, at the same time when or immediately before or after the yarn ends (YP1)(YB1) are sucked by the yarn end untwisting nozzles (103)(104), the yarn handling lever (105) is moved in the direction of (R) apart from the yarns. Whereby the yarn ends (YP1)(YB1) are sucked deeply into the untwisting nozzles and then untwisted by the fluid injection into the state suitable for yarn splicing.

It is noted that the untwisting nozzles (103)(104) preferably start their suction periods immediately before yarn cutting effected by the yarn cutters (106)(107).

This is resulted from the reason that, since the tension is applied to the yarns (Y) due to the sucking action by both suction mouth and relay pipe when they are cut, there may occur a fear that the yarn ends (YP1)(YB1) got free attendant on yarn cutting fly off from the opening positions of the untwisting nozzles (103)(104) and hence suction of the yarn ends can not be effected by the untwisting nozzles.

Incidentially, supply of the fluid to the untwisting nozzles is carried out by switching a valve with a not shown solenoid.

(IV) Yarn splicing process

With the yarn ends (YP1)(YB1) being untwisted by the yarn end untwisting nozzles (103)(104) into the state suitable for yarn splicing, as previously noted, at the same time when or immediately before or after the untwisting nozzles (104)(103), flexible pipes (87) and the fluid injection nozzles (88) are all stopped in their sucking actions, the yarn handling lever (105) is operated again to draw the yarn ends (YP1)(YB1) out of the untwisting nozzles (103)(104) while guiding them and then place the untwisted yarn ends one above the other at a predetermined position in the yarn splicing member, as shown in FIG. 36.

On this occasion, one lever (32) of the yarn handling lever (105) is turned up to the position where it abuts against the stopper (35) and the yarn regulating device (102) is operated to turn coming into the sate as shown in FIGS. 36 and 33, thereby causing the yarns (YP)(YB) to be bent between the yarn splicing hole (54) and the clamping devices (108)(109), more strictly, between the yarn splicing hole (54) and the yarn handling levers (32)(33), with the aid of the yarn regulating plates (83*a*)(83*b*) and the guide rods (28*a*)(28*b*).

The yarn handling lever (105) and the yarn regulating device (102) permits the yarn ends (YP1)(YB1) having been inserted in the nozzle ports of the untwisting nozzles (103)(104) to be drawn into the yarn splicing hole (54) of the yarn splicing member (101), so that the yarn ends (YP1)(YB1) are positioned and set in contact with each other by the yarn regulating device (102) and the control plates (25)(26) shown in FIG. 9.

Next, after such setting of the yarn ends, yarn splicing is effected by the actions of whirling flows of the compressed fluid injected from the first and second fluid injection nozzles (56)(57) shown in FIG. 9, as well as by the action of a direct impact flow of the compressed fluid injected from the third fluid injection nozzles (58).

By referring now to FIG. 37, there will be explained the principle of yarn splicing using the above-mentioned apparatus. First, the yarn ends (YP)(YB) are so overlapped that the leading end parts of the yarn ends are directed in the opposite directions to each other in a parallel or crossing relation. The leading end parts of the yarn ends are brought into the untwisted state so as to be ready for yarn splicing. This untwisted part represents the part where the specific twist of the yarns becomes almost zero or the number of twistings is smaller than the specific twist number of the yarns. Preferably, such an untwisted state is optimum that fibers constituting each yarn end part are in the substantially parallel condition.

Further, the leading end parts of the yarns (YP)(YB) are placed under no restraint but free state, while they are clamped at the positions spaced from the respective leading ends by a predetermined distance with the clamping devices (108)(109), these clamped points being denoted at K1, K2 in FIG. 37. The clamped points (K1)(K2) serve as fixed points such that twist applied to the leading end parts of the yarn ends will not propagate over them.

In the state thus superimposed, both yarns (YP)(YB) are turned in the different directions (X1)(X2) at two positions (C1)(C2) in different regions and, at the same time, the direct impact flow is applied to the middle point (M). That is, the direct impact flow promotes entangling of fibers with one another at the middle part, while the whirling flows forms the joint which has the actual twist in the same direction as the specific twist of each yarn.

The whirling directions (X1)(X2) are dependent on the specific twist direction of the yarns to be spliced. The whirling direction (X1) at the position (C1) is a direction in which the specific twist of the yarn is untwisted between the clamped point (K1) of the yarn (YP) and the twisting part (C1), while the whirling direction (X2) at the clamped point (K2) is set in a direction (X2) where the specific twist of the yarn is untwisted between the clamped point (K2) of the yarn (YB) and the twisting part (C2). Since the yarns (YP)-(YB) have the Z-twist in the illustrated case, there should be used a yarn splicing member which has the yarn splicing nozzle unit (59) for Z-twist as shown in FIGS. 12–15.

In case the yarns have the S-twist, it is a matter of course to use, for example, the yarn splicing nozzle unit (64) as shown in FIGS. 16–19, for ensuring that the whirling directions (X1)(X2) are reversed as compared with those shown in FIG. 37.

Next, there will be explained the behavior of yarns caused by the foregoing whirling action.

For the purpose of explanation, the part of the yarn (YB) from the clamped point (K2) to the leading end of the yarn end is divided into four regions (A1) through (A4).

In other words, the region (A1) denotes a region from the whirling flow applying point (C1) to the leading end of the yarn end, the region (A2) from the whirling flow applying point (C1) to the center position (M) between both whirling flow applying points (C1)(C2), the region (A3) from the center position (M) to the whirling flow applying point (C2), and the region (A4) denotes a region from the whirling flow applying point (C2) to the clamped point (K2). Similarly, the yarn (YP) is also divided into four regions (B1) through (B4) from the leading end of the yarn end.

Due to the whirling flow in the direction of the arrow (X1) at the whirling flow applying point (C1), the regions (A1)(A2) of the yarn (YB) and the regions (B3)(B4) of the yarn (YP) are turned in the same direction as that of the arrow (X1).

At this time, although the twisting force for S-twist is applied to the yarns in the regions (A1)(B4) and that for Z-twist is applied to the yarns in the regions (A2)(B3), the S-twist in the region (A1) will be disappeared and the actual Z-twist remains in the region (A2) because the region (A1) of the yarn (YB) is under the free state, i.e., open end state. At the same time, the untwisted fibers in the regions (A2)(A3) are twisted into Z-twist while being entangled and combined with one another, and the yarn end in the region (A1) is finally united and twisted in the Z-direction together with the yarn (YP) in the region (B4). If the yarn in the region (B4) is also under the untwisted state, the fibers in the regions (A1)(B4) are entangled and combined with one another into the form of a single yarn of Z-twist.

It is to be noted that there occurs a tendency toward untwisting in the region (B4) of the yarn (YP) because it is turned in the direction where the specific twist thereof will be untwisted. But, by restricting turning of the yarn parts in the regions (B3)(B4) as much as possible, the yarn end in the regions (A1)(A2) of the yarn (YB) is mainly turned about the yarn (YP), thus coming into the condition that the yarn (YB) itself is twisted into Z-twist and wound round the yarn (YP) in the Z-direction.

The whirling flow in the direction of the arrow (X2) at the whirling flow applying point (C2) also causes the similar condition to the above. More specifically, since the leading end (B1) of the yarn (YP) is under the free state, Z-twist is applied to the region (B2) of the yarn (YP) and, at the same time, the fibers in the regions (B1)(B2) are entangled and combined with the fibers of the yarn (YB) into the form of a single yarn while being wound in that Z-direction.

Accordingly, the yarn end (A1)(A2) of the yarn (YB) on the side (C1) relative to the middle point (M) between the whirling flow applying points (C1)(C2) is wound round the regions (B4)(B3) of the yarn (YP) while being twisted in the Z-direction, i.e., the same direction as the specific twist of the yarn, and the yarn end (B1)(B2) of the yarn (YP) on the side (C2) relative to the middle point (M) is wound round the regions (A4)(A3) of the yarn (YB) while being twisted in the Z-direction, i.e., the same direction as the specific twist direction of the yarn. As a result, there can be obtained the twist in the same direction as the original twist direction of the yarn all over the joint. Since the overlapped parts of the yarn ends are brought into the untwisted state before yarn splicing, the joint after yarn splicing has the same structure as that of the original yarn.

Moreover, in the middle part (M) between the two positions (C1)(C2), fibers of both yarns (YP)(YB) which are untwisted and arranged in parallel are penetrated and entangled with one another into such a mixed state that those two yarns are undistinguishable, by the action of the direct impact flow directing toward the center of the yarn splicing hole. In this state, Z-twist is applied the thereto, thus resulting in the structure of a single yarn. In case the nozzle (71) for injecting the direct compact flow has the flat form as shown in FIGS. 20–23, the region of the middle part (M) is widened so that the direct compact current acts on the intermediate portion of the overlapped parts with a broader width. It is thus possible to further promote mixing of the fibers and hence to improve the strength of the joint.

The joint of yarns thus spliced is shown in FIG. 38. FIG. 38 is a sketch of the joint in case that both yarn ends have been untwisted all over the superimposed parts of the yarn ends. As seen from this sketch, the joint (Y1) has the actual twist (Z-twist) in the same direction all over the joint in the form of a single yarn. That is, it will be found that the two yarns can not be distinguished from each other, and the fibers of both yarn ends are twisted while being mixed and combined with one another into the form of a single yarn. In this case, there can be attained the joint of high quality which has yarn characteristics comparable to those of the single parent yarn. Further, the number of horn portions projecting on both ends of the joint is decreased.

The measured values of strength of the joint are as follows. In case of using wool, Nm 11, a yarn splicing member provided with the nozzle as shown in FIGS. 12–15, supply air pressure of 6.0 kg/cm$^2$ and the nozzles (56)(57)(58) of the same diameter, there were obtained the joint strength of 722 g and the retention factor of 83% for strength of the parent yarn of 879 g. Besides, the sampling number was 500.

According to the present invention, as fully described in the above, first and second fluid injection nozzle openings for producing two whirling flows in the directions opposite to each other are provided at two circumferential positions of a yarn splicing hole, and a third fluid injection nozzle opening for producing a non-whirling flow is provided midway between the first and second nozzles. Whereby, fibers in the overlapped intermediate portion can be positively mixed with one another, particularly when splicing the yarn ends of long fibers. As a result, there can be attained the joint of high quality which has the yarn strength comparable to the parent yarn and which has less portions in appearance thereof.

What is claimed is:

1. A yarn splicing apparatus for spun yarns characterized in that first and second fluid injection nozzles for producing two whirling flows in the directions opposite to each other are provided at two circumferential positions of a yarn splicing hole, and a third fluid injection nozzle for producing a non-whirling flow is provided midway between said first and second nozzles.

2. A yarn splicing apparatus as claimed in claim 1, wherein positions of said first, second and third fluid injection nozzles in the axial direction of the yarn splicing hole are so selected that the first and second nozzles locate in symmetrical positions spaced from yarn splicing hole end faces by a certain distance, respectively, and the third nozzle locates at the center of the yarn splicing hole.

3. A yarn splicing apparatus as claimed in claim 2, wherein positions of said first and second fluid injection nozzles are so determined to cause the yarn ends to be whirled in the untwisting directions.

4. A yarn splicing apparatus as claimed in claim 3, wherein said first and second fluid injection nozzles open to the yarn splicing hole with a circular section, and said third fluid injection nozzle is formed to have a flat opening in cross section elongated in the axial direction of the yarn splicing hole.

5. A yarn splicing apparatus for spun yarns including a yarn splicing member characterized in that a yarn splicing nozzle unit is fitted detachably within the yarn splicing member and the yarn splicing nozzle unit comprises a cylindrical yarn splicing hole formed along the axial direction of the yarn splicing nozzle unit, a slit for inserting the yarn therethrough formed all over the circumference of the yarn splicing hole in a tangential direction, first and second fluid injection nozzles which are bored to be open to the yarn splicing hole in a tangential relation at such two positions as causing fluid flows injected from those nozzles to be whirled in the opposite directions, and a third fluid injection nozzle open to the yarn splicing hole in a non-tangential relation.

6. A yarn splicing apparatus as claimed in claim 5, wherein said yarn splicing unit is further provided flanges at both peripheral end portions thereof and the first, second and third nozzles are open to an fluid passage which is formed in cooperation of the peripheral wall surface of a nozzle unit inserting hole formed in the yarn splicing member and the flanges and is connected to a fluid supply path.

7. A yarn splicing apparatus as claimed in claim 5 or 6, wherein said yarn splicing nozzle unit has substantially a cylindrical form.

8. A yarn splicing apparatus as claimed in claim 5 or 6, wherein said yarn splicing nozzle unit has a square pillar form as a whole.

* * * * *